US011147330B2

(12) United States Patent
Ruffolo

(10) Patent No.: US 11,147,330 B2
(45) Date of Patent: Oct. 19, 2021

(54) HEADGEAR WITH STORAGE

(71) Applicant: Danielle Marie Ruffolo, Dayton, OH (US)

(72) Inventor: Danielle Marie Ruffolo, Dayton, OH (US)

( * ) Notice: Subject to any disclaimer, the term of this patent is extended or adjusted under 35 U.S.C. 154(b) by 0 days.

(21) Appl. No.: 15/786,523

(22) Filed: Oct. 17, 2017

(65) Prior Publication Data

US 2018/0103708 A1 Apr. 19, 2018

Related U.S. Application Data

(60) Provisional application No. 62/496,360, filed on Oct. 17, 2016.

(51) Int. Cl.
*A42B 1/241* (2021.01)

(52) U.S. Cl.
CPC ..... *A42B 1/241* (2013.01)

(58) Field of Classification Search
CPC ..... A42B 1/241; A42B 1/02; A42B 1/061; A42B 1/062; A42B 1/063; A42B 1/066; A42B 1/24
USPC ..... 2/209.13, 247, 10, 12, 15, 425
See application file for complete search history.

(56) References Cited

U.S. PATENT DOCUMENTS 619,719 A * 2/1899 Cherry ..... A42B 1/24 206/243
2,335,630 A * 11/1943 Bachardy ..... A42C 5/04 2/7
4,386,437 A 6/1983 Fosher
4,451,935 A * 6/1984 Henschel ..... A42B 1/241 2/181
4,484,363 A * 11/1984 Varanese ..... A42B 1/008 2/181
4,551,859 A * 11/1985 Gerhardt ..... A42B 1/066 2/172
4,991,236 A * 2/1991 Pritchett ..... A42B 7/00 132/57.1
5,056,164 A * 10/1991 Lisle ..... A42B 1/062 2/453
5,410,746 A * 4/1995 Gelber ..... A42B 1/245 2/209.13
5,623,732 A * 4/1997 Olajide, Jr. ..... A42B 1/064 2/172
5,724,678 A * 3/1998 McCallum ..... A42B 1/241 2/209.13
5,860,165 A * 1/1999 Cvijanovich ..... A42B 1/066 2/172
5,887,287 A * 3/1999 Potochnik ..... A42B 1/067 2/172
5,996,124 A * 12/1999 Asp, Jr. ..... A42B 1/241 2/172
6,023,788 A * 2/2000 McCallum ..... A42B 1/241 2/181

(Continued)

*Primary Examiner* — Khoa D Huynh
*Assistant Examiner* — Grace Huang
(74) *Attorney, Agent, or Firm* — Kilpatrick Townsend & Stockton LLP

(57) ABSTRACT

A headgear includes a main portion and at least one storage compartment attached to an interior surface of the main portion. The at least one storage compartment includes an anchor edge. The anchor edge is attached to the interior surface of the headgear. The at least one storage compartment may include at least one pocket and each pocket may include at least one opening.

12 Claims, 4 Drawing Sheets

(56) References Cited

U.S. PATENT DOCUMENTS

| | | | | |
|---|---|---|---|---|
| 6,170,087 | B1 * | 1/2001 | Brannon | A42B 1/241 2/209.13 |
| 6,671,885 | B2 | 1/2004 | Viggiano | |
| 7,120,937 | B2 * | 10/2006 | Monshouwer | A42B 1/069 2/171 |
| 7,862,194 | B2 * | 1/2011 | Seade | A42B 1/245 2/195.1 |
| 10,441,016 | B2 * | 10/2019 | Byrd | A42B 1/24 |
| 2002/0035745 | A1 * | 3/2002 | Spell | A42B 1/066 2/209.13 |
| 2004/0222253 | A1 * | 11/2004 | Linch | A42B 1/241 223/85 |
| 2008/0163407 | A1 * | 7/2008 | Gardner | A42B 1/241 2/209.13 |
| 2012/0060259 | A1 * | 3/2012 | Falken | A42B 1/241 2/209.13 |
| 2014/0298567 | A1 * | 10/2014 | Potts | A42B 1/241 2/171.2 |
| 2015/0150726 | A1 * | 6/2015 | Flaxman | A42B 7/00 128/858 |
| 2016/0128411 | A1 * | 5/2016 | Ayres | A42B 1/008 2/172 |

* cited by examiner

HEADGEAR WITH STORAGE

CROSS REFERENCE TO RELATED APPLICATION

This application is related to and claims priority benefit from U.S. Provisional Application No. 62/496,360 ("the '360 application"), filed on Oct. 17, 2016, entitled CAP COMPARTMENT HANDY HAT. The '360 application is hereby incorporated in its entirety by this reference.

FIELD OF THE INVENTION

The field of the invention relates to headgear with at least one integral or detachable storage compartment.

BACKGROUND

In addition to aesthetic and fashion purposes, clothing has utilitarian purposes, such as providing storage for the wearer. However, some garments provide insufficient storage and/or are not designed to be compatible with storage. Some garments may be designed without pockets or other storage features due to aesthetic or functional reasons, may include fake pockets, or may include pockets that are too small for practical usage.

In certain situations, it may be desirable to design garments, such as headgear, with at least one storage compartment.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a headgear comprises: a main portion; and at least one storage compartment attached to an interior surface of the main portion, wherein: the at least one storage compartment comprises an anchor edge; and the anchor edge is attached to the interior surface.

According to certain embodiments of the present invention, a headgear comprises: a main portion; and at least one storage compartment attached to an interior surface of the main portion, wherein the at least one storage compartment comprises a retracted configuration and a deployed configuration. The at least one storage compartment comprising: a rear surface that faces towards the interior surface; a front surface opposite the rear surface and faces away from the interior surface; wherein in the retracted configuration, the rear surface contacts the interior surface and the front surface faces away from the interior surface; an anchor edge; a free edge opposite the anchor edge; at least one longitudinal edge extending between the anchor edge and the free edge; and at least one opening formed through the front surface and offset from the free edge; wherein the at least one opening comprises a pocket securement device for securing the at least one opening; wherein the front surface and the rear surface are permanently attached to the interior surface of the main portion along the anchor edge of the at least one storage compartment via sewing; an attachment element disposed on the rear surface and offset from the free edge and the anchor edge; wherein, in a retracted configuration, the rear surface of the at least one storage compartment is attached to the interior surface of the main portion and the at least one storage compartment is covered by the exterior surface of the main portion; and wherein, in a deployed configuration, the rear surface of the at least one storage compartment is detached from the interior surface of the main portion; and wherein the at least one storage compartment is configured to pivot between the retracted configuration and the deployed configuration.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1-4 illustrate embodiments of headgear 100 that includes at least one storage compartment 101. Each storage compartment 101 may include at least one pocket and each pocket may include at least one opening 102. In some embodiments, each storage compartment 101 includes a single pocket with a single opening 102 while in other embodiments, each storage compartment 101 includes multiple pockets. The opening 102 of the pocket may be secured using at least one pocket securement device 115. The pocket securement device 115 may comprise at least one of a hook and loop fastener, at least one button, at least one snap, spring steel (to snap in place), at least one drawstring, at least one folding flap, at least hook and eye, a zipper, a press seal (grip seal), or a combination thereof.

Figure 1:
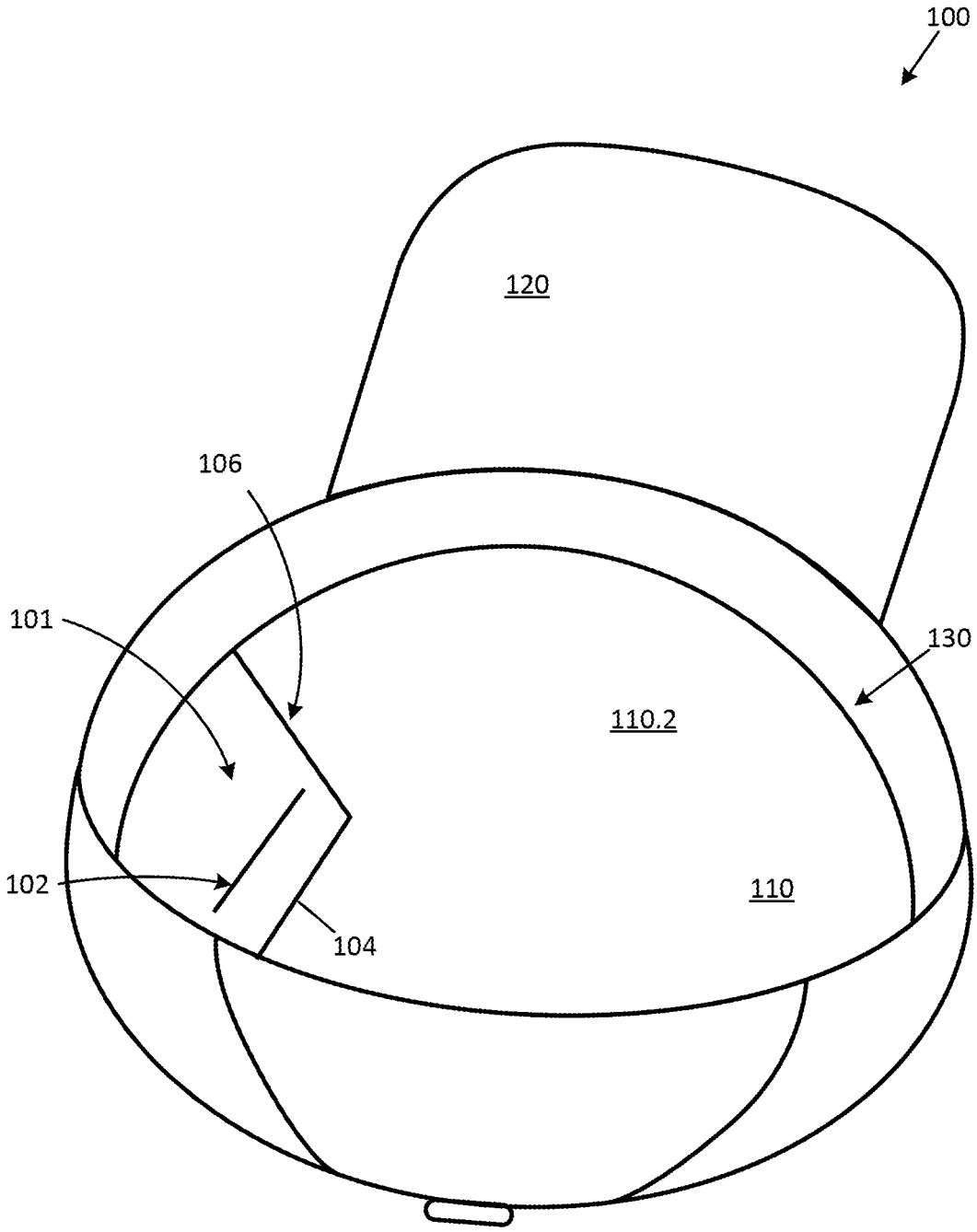
FIG. 1 is a perspective interior view of a headgear according to certain embodiments of the present invention.

As shown in FIGS. 1 and/or 2, the headgear 100 may include a main portion 110, at least one brim 120 that extends around a portion of the perimeter of the main portion 110, and a sweatband 130. Although the headgear 100 is illustrated as a baseball hat, the headgear 100 may be any type of hat including, but not limited to, sombreros, fedoras, bowlers, boaters, bucket hats, deerstalkers, hard hats, pith helmets, cowboy hats, top hats, and yarmulkes. In some embodiments, the headgear 100 does not include a brim 120 or includes a brim 120 that extends around the entire perimeter of the headgear 100. In some embodiments, the brim 120 is disposed approximately 90° from the storage compartment 101.

Figure 2:
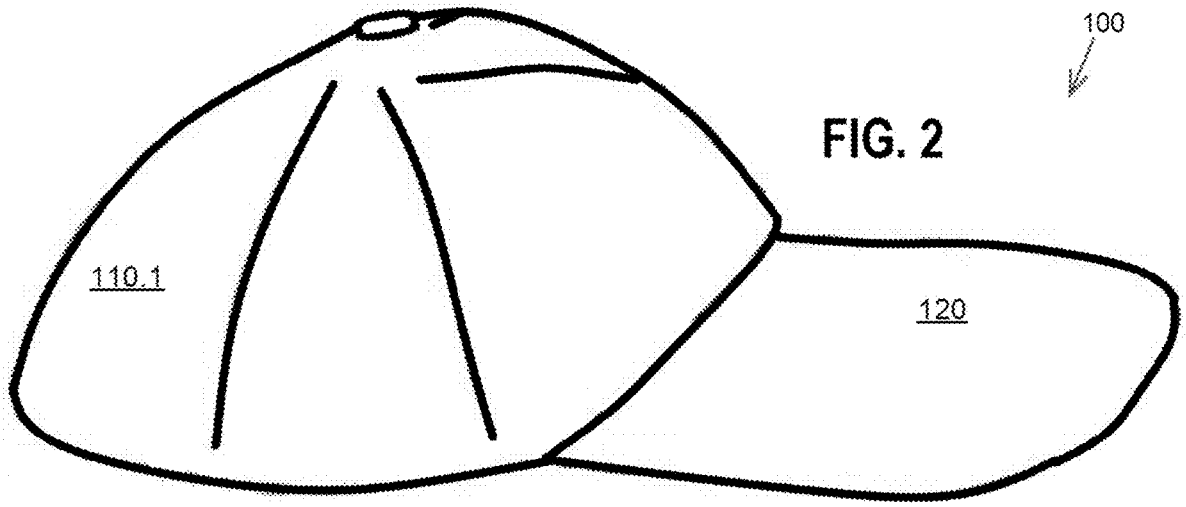
FIG. 2 is a side view of the headgear of FIG. 1.
Figure 3A:
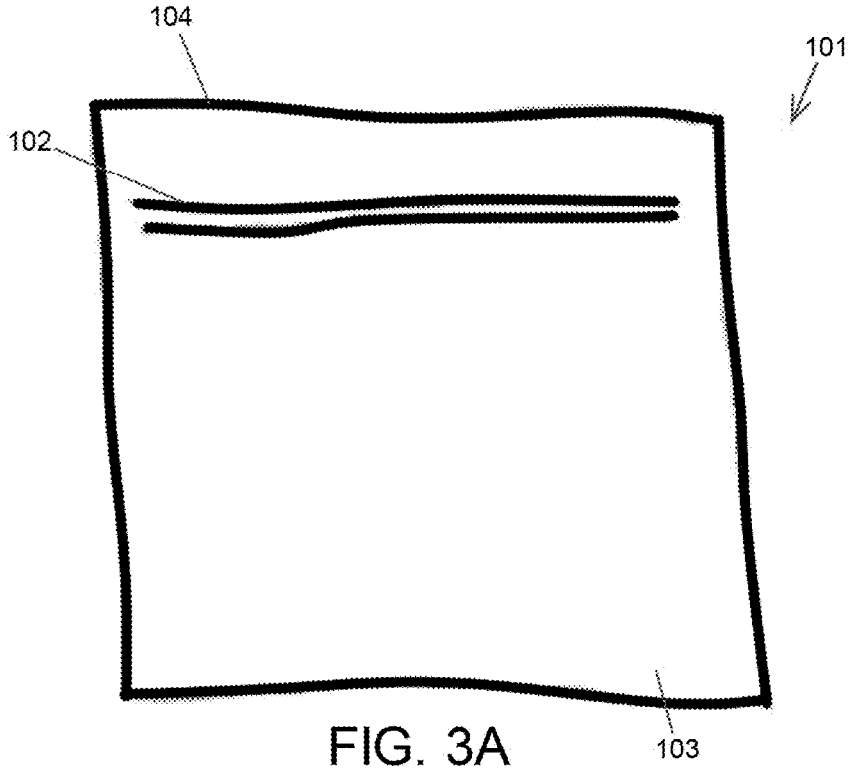
FIGS. 3A and 3B are front views of a storage compartment of the headgear of FIG. 1.

In some embodiments, the at least one storage compartment 101 may be located in the interior of the headgear adjacent to an interior surface 110.2 of the main portion 110. The at least one storage compartment 101 may include an anchor edge 103 and at least one free edge 104 opposite the anchor edge 103 (see FIGS. 3A and 3B). In some embodiments, the opening 102 is disposed approximately at the free edge 104 (see FIG. 4). In other embodiments, the opening 102 is offset from the free edge 104 (see FIGS. 3A and 3B). As shown in FIGS. 1 and 4, the anchor edge 103 may be attached to the interior surface 110.2 near and/or behind the sweatband 130. In some embodiments, the anchor edge 103 is permanently attached to the main portion 110 near and/or behind the sweatband 130. In other embodiments, the anchor edge 103 is removably attached to the main portion 110 near and/or behind the sweatband 130. The anchor edge 103 may be secured using at least one of sewing, a hook and loop fastener, at least one button, at least one snap, spring steel (to snap in place), at least one drawstring, at least one folding flap, at least hook and eye, a zipper, a press seal (grip seal), or a combination thereof. In some embodiments, the attachment of the anchor edge 103 to the main portion 110 acts as a hinge such that the at least one storage compartment 101 pivots between a retracted configuration as shown in FIG. 1 and a deployed configuration in FIG. 4. In some embodiments, in the retracted configuration, as shown in FIG. 2, the at least one storage compartment 101 is not visible (i.e., is covered by exterior surface 110.1). In the retracted position, when the headgear 100 is worn, the at least one storage compartment 101 is located between the interior surface 110.2 and the wearer's head.

As shown in FIG. 4, the at least one storage compartment 101 may include an attachment element 105 that attaches the at least one storage compartment 101 to the interior surface 110.2. In some embodiments, when the at least one storage compartment 101 is attached to the main portion 110 at the anchor edge 103, the attachment at the attachment element 105 prevents the at least one storage compartment 101 from pivoting. The attachment element 105 may include at least one of an adhesive, a hook and loop fastener, at least one button, at least one snap, spring steel (to snap in place), at least one drawstring, at least one folding flap, at least hook and eye, a zipper, a press seal (grip seal), or a combination thereof. In some embodiments, the headgear 100 may be configured without an attachment element such that the user's head may press the at least one storage compartment 101 against the interior surface 110.2.

Figure 3B:
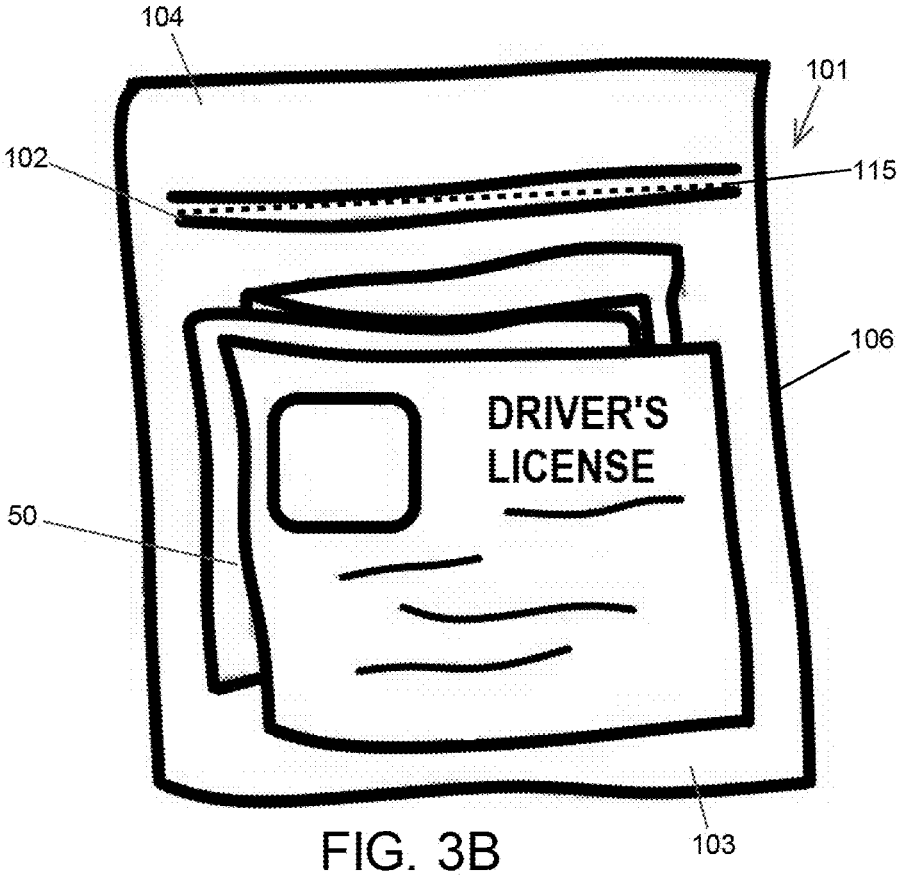
Figure 4:
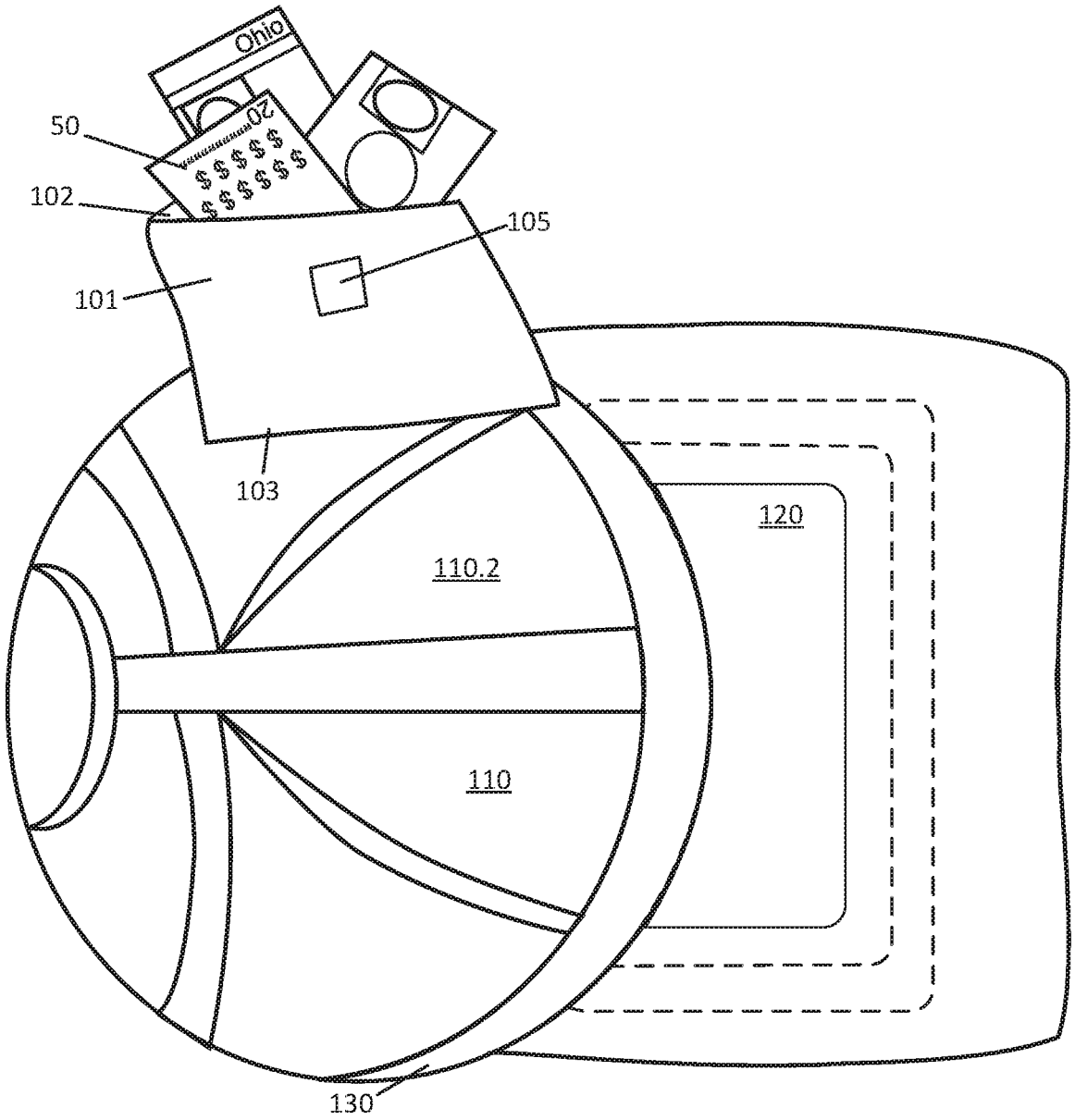
FIG. 4 is a perspective interior view of the headgear of FIG. 1.

The at least one storage compartment 101 may include transparent and/or translucent material such that objects 50 inside the at least one storage compartment 101 may be visible (see FIG. 3B). In other embodiments, the at least one storage compartment 101 may include an opaque material as shown in FIG. 3A. In some embodiments, each storage compartment 101 is a waterproof or water-resistant material that is different from the material of the other components of the headgear 100. In other embodiments, each storage compartment 101 is constructed from the same material as the headgear 100. The at least one storage compartment 101 may be sold as a separate item such that a user may purchase a storage compartment 101 to install in a headgear.

The objects 50 stored in the at least one storage compartment 101 may include at least one of keys, identification cards, currency, hair ties, credit/debit cards, lip balm, gum, or any other appropriate object.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A headgear comprising:

a main portion having an interior surface and an exterior surface;

at least one storage compartment having a retracted configuration and a deployed configuration, the at least one storage compartment comprising:

a rear surface that faces towards the interior surface;

a front surface opposite the rear surface and faces away from the interior surface;

wherein in the retracted configuration, the rear surface contacts the interior surface and the front surface faces away from the interior surface;

an anchor edge;

a free edge opposite the anchor edge;

at least one longitudinal edge extending between the anchor edge and the free edge; and at least one opening formed through the front surface and offset from the free edge;

wherein the at least one opening comprises a pocket securement device for securing the at least one opening; and wherein the front surface and the rear surface are permanently attached to the interior surface of the main portion along the anchor edge of the at least one storage compartment via sewing;

an attachment element disposed on the rear surface and offset from the free edge and the anchor edge;

wherein, in a retracted configuration, the rear surface of the at least one storage compartment is attached to the interior surface of the main portion and the at least one storage compartment is covered by the exterior surface of the main portion; and wherein, in a deployed configuration, the rear surface of the at least one storage compartment is detached from the interior surface of the main portion; and wherein the at least one storage compartment is configured to pivot between the retracted configuration and the deployed configuration.

2. The headgear of claim 1, further comprising a sweatband, wherein the anchor edge is permanently attached to a portion of the interior surface adjacent to the sweatband such that the sweatband is configured to cover the anchor edge.

3. The headgear of claim 1, wherein the at least one storage compartment pivots about the anchor edge to move the at least one storage compartment between the retracted configuration and the deployed configuration.

4. The headgear of claim 1, wherein, when the headgear is worn and the at least one storage compartment is in the retracted configuration, the at least one storage compartment is not visible.

5. A headgear comprising:

a main portion having an interior surface and an exterior surface;

at least one storage compartment having a retracted configuration and a deployed configuration, the at least one storage compartment comprising:

a rear surface that faces towards the interior surface;

a front surface opposite the rear surface and faces away from the interior surface;

wherein in the retracted configuration, the rear surface contacts the interior surface and the front surface faces away from the interior surface;

an anchor edge;

a free edge opposite the anchor edge;

at least one longitudinal edge extending between the anchor edge and the free edge; and wherein the front surface and the rear surface are permanently attached to the interior surface of the main portion along the anchor edge of the at least one storage compartment via sewing;

an attachment element disposed on the rear surface and offset from the free edge and the anchor edge;

wherein, in a retracted configuration, the rear surface of the at least one storage compartment is attached to the interior surface of the main portion and the at least one storage compartment is covered by the exterior surface of the main portion; and wherein, in a deployed configuration, the rear surface of the at least one storage compartment is detached from the interior surface of the main portion; and wherein the at least one storage compartment is configured to pivot between the retracted configuration and the deployed configuration.

6. The headgear of claim 5, wherein, when the headgear is worn and the at least one storage compartment is in the retracted configuration, the at least one storage compartment is not visible.

7. The headgear of claim 5, wherein the at least one storage compartment comprises at least one opening, wherein the at least one opening is formed through the front surface and offset from the free edge.

8. The headgear of claim 7, wherein the at least one opening comprises a pocket securement device for securing the at least one opening.

9. The headgear of claim 5, further comprising a sweatband.

10. The headgear of claim 9, wherein the anchor edge is permanently attached to a portion of the interior surface adjacent to the sweatband such that the sweatband is configured to cover the anchor edge.

11. The headgear of claim 5, further comprising a brim.

12. The headgear of claim 11, wherein the brim is disposed 90° from the at least one storage compartment.

* * * * *